United States Patent [19]

Fields, Jr.

[11] Patent Number: 4,458,935

[45] Date of Patent: Jul. 10, 1984

[54] SKI EQUIPMENT CARRIER

[75] Inventor: John Fields, Jr., Haverhill, Mass.

[73] Assignee: Ski Accessories, Inc., Haverhill, Mass.

[21] Appl. No.: 463,252

[22] Filed: Feb. 2, 1983

[51] Int. Cl.[3] ..... A63C 11/02

[52] U.S. Cl. ..... 294/147; 294/116; 294/163; 294/166

[58] Field of Search ..... 294/16, 28, 115, 116, 294/137, 141–143, 146, 147, 159–163, 165–167, 169; 211/60 SK; 224/917; 280/814, 815

[56] References Cited

U.S. PATENT DOCUMENTS

| | | | |
|---|---|---|---|
| 294,147 | 2/1884 | Poole | 294/115 |
| 2,015,486 | 3/1934 | Linfesty | 294/115 |
| 2,482,576 | 12/1946 | Comstock | 294/115 X |
| 3,086,688 | 4/1963 | Vikre | 294/163 |
| 3,114,487 | 3/1963 | Miller et al. | 294/147 |
| 3,126,222 | 3/1964 | Stuart | 294/16 |
| 3,718,242 | 2/1973 | Larson | 294/143 X |
| 3,861,733 | 1/1975 | Vander Mey | 294/16 X |
| 3,917,137 | 11/1975 | Wilkins | 294/147 X |
| 3,935,977 | 2/1976 | Bonnett | 294/147 |
| 3,990,655 | 11/1976 | Covell | 294/147 |
| 4,040,551 | 8/1977 | Brumbaugh | 294/147 |
| 4,043,493 | 8/1977 | Camelio | 294/147 X |
| 4,059,209 | 11/1977 | Grisel | 294/143 X |
| 4,326,747 | 4/1982 | Finnegan | 294/147 |

FOREIGN PATENT DOCUMENTS 562043 5/1975 Switzerland .

*Primary Examiner*—Johnny D. Cherry
*Attorney, Agent, or Firm*—Bacon & Thomas

[57] ABSTRACT

A device is presented for carrying ski equipment such as a pair of skis and a pair of ski poles. The device has a pair of clamping members which clamp around a pair of skis to hold them in a back-to-back orientation while being carried. A linear cam mechanism is included in the device to enable the user to open and close the clamping members with one hand. A further device is provided for carrying a pair of ski poles, this device being attachable to the lower portion of the clamping device. When not in use, this ski pole carrier is attached to one of the ski poles and folded so as not to interfere with the normal usage of the pole. The carrying device is also capable of being secured by a standard cable locking device so as to prevent unauthorized removal of either the skis or the ski poles.

11 Claims, 5 Drawing Figures

FIG 1
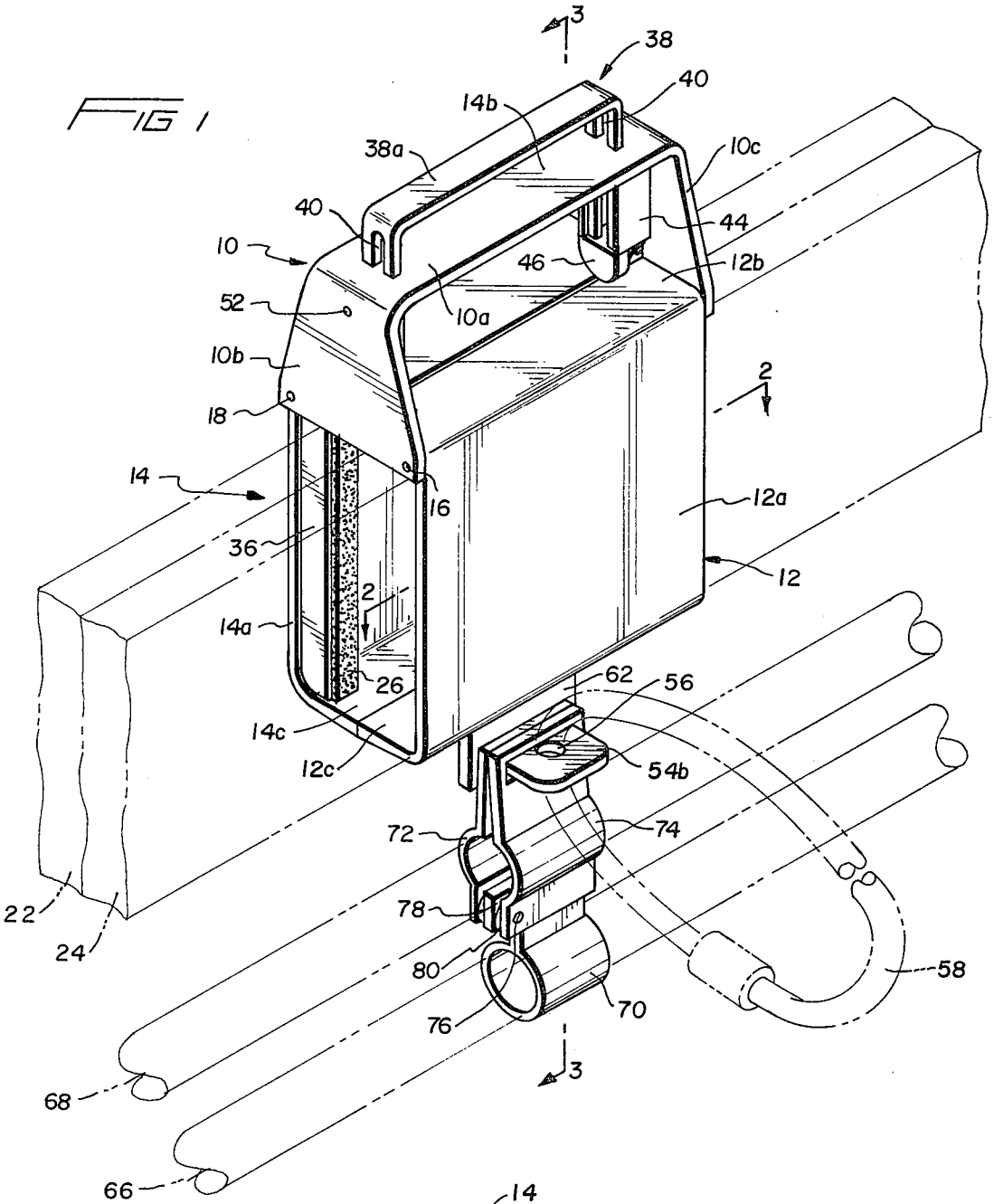
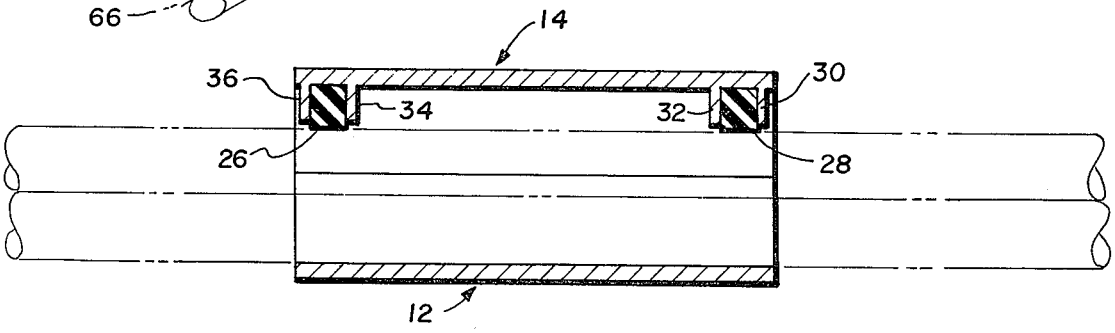
FIG 2

SKI EQUIPMENT CARRIER

FIELD OF INVENTION

The present invention relates to carrying devices, namely those devices specifically directed toward carrying skis and ski poles.

BACKGROUND OF THE INVENTION

The number of people enjoying the sport of skiing has increased dramatically in the last decade. One of the major reasons for this increase is the rapid advance in ski equipment design. Lighter weight and more comfortable ski boots, more sophisticated and safer ski bindings along with the lighter weight materials used in fabricating skis and ski poles have broadened the appeal of the sport and enabled many thousands to participate who would otherwise have not done so. This increase in the number of skiing participants has resulted in an opening of a number of new ski areas and expansions of those already in existence.

Despite all of the advances in the design of the ski equipment and the increase in the number and size of skiing areas, the skier, whether he/she is a competition racer or merely a week-end recreational skier, is confronted with the fundamental problem of transporting the ski equipment from the parking area or lodge to the skiing area. Although the skis, bindings and poles are typically not heavy, their sheer size makes them unwieldy to carry and maneuver especially when the ski area is crowded.

There have been numerous devices developed over the years for carrying skis and poles. These devices have assumed all sizes and shapes in an attempt to make the skier's task more manageable, but none has completely or adequately solved the problem. In one of the more popular devices, the skis and poles are held in position on either side of a central section while a pair of flaps are folded over the outside. A tongue on one of the flaps is inserted through a slot in the center section and a slot in the opposite flap and is held in position by the insertion of a cable locking device. Although this device works adequately once it is fastened together, the skier is confronted with a difficult, if not virtually impossible, task of holding a pair of skis and ski poles against either side of this center section with one hand while attempting to fold two flaps over and insert the tongue with the other hand. Since this task is virtually impossible while wearing ski gloves or mittens, the skier must remove them and incur the inconvenience of cold hands or, under extreme conditions, risk the danger of frost bite.

In another device, the carrier consists of a pair of tongue-like elements pivotally joined near the center with a pair of handles and a cavity for carrying ski poles located above the pivot and a cavity for retaining the skis located below the pivot. Again, however, the skier is confronted with the problem of holding four elements, i.e., two skis and two ski poles, in position while attempting to close the cavities with the other hand. While it appears that this device renders the problem somewhat more manageable, it still remains a formidable task.

Another of the prior art devices consists of a pair of parallel ski gripping plates, spring-biased away from each other. In order to use this device, the skier must, once again, hold his skis between the plates while forcing the plates towards each other and manipulating a tongue which extends from one plate through the opposite plate. Once the plates are pressed against the skis, a ratchet on the tongue is engaged with a slot on one of the plates to hold them in position. Again, the skier is confronted with the problem of manipulating a plurality of articles with one hand while having to carry out complicated manipulations with the other hand in order to lock the device in position.

Other devices are known wherein the skis and poles are attached to separate portions of the carrier. While these devices render the manipulations somewhat easier, they do not provide adequate safeguards against unauthorized removal of either the skis or the poles. The skis and poles are retained in position by toggle clamps and no provision is made for locking the equipment in the carrier. This is a great disadvantage, since skiers must often leave their skis and poles in a designated area at the resort when eating meals or taking a break from skiing.

Thus, as can be seen, the prior art ski equipment carriers are not capable of being easily opened and closed with one hand, providing separate, attachable elements for holding the skis and the ski poles, nor are they capable of locking the elements together to provide adequate safeguards against theft of the equipment.

SUMMARY OF THE INVENTION

The instant invention provides a ski equipment carrying device which obviates the problems of the prior art devices. The ski equipment carrier according to this invention provides a handle member having a pair of clamping members pivotally attached thereto such that the clamping members may be placed around a pair of skis oriented in a back-to-back relationship. A cam actuating device associated with the handle allows the skier to open and close the clamping members with one hand, leaving the other hand free to hold the skis. A separate holding device is utilized to hold the pair of ski poles, this device being attachable to the lower portion of the clamping members. When not in use, the ski pole holder remains attached to one of the ski poles and is foldable in such a way that it presents no obstruction to the normal use of the ski poles. The invention also accommodates a standard cable locking apparatus which not only prevents the removal of the ski pole carrier from the clamping members, but also prevents opening of the clamping members. This prevents unauthorized removal of either the skis or the poles from the carryng device.

BRIEF DESCRIPTION OF THE DRAWINGS

FIG. 1 is a perpsective view of the ski equipment carrying device according to the invention showing the clamping members in closed position and assembled with the ski pole carrier.

FIG. 2 is a horizontal cross section of the ski carrier taken along lines 2—2 in FIG. 1.

DETAILED DESCRIPTION OF THE PREFERRED EMBODIMENT

The ski equipment carrier according to the invention comprises handle member 10 having hand gripping portion 10*a* and depending portions 10*b* and 10*c* located on either end of the hand gripping portion. These depending portions may be formed integrally with the gripping portion or may be formed by separate pieces attached thereto. Clamping members 12 and 14 are attached to depending portions 10*b* and 10*c* by pivoting elements 16 and 18. Pivot elements 16 and 18 may be any known means, such as a rod, screw, rivets, etc., which will attach clamping members 12 and 14 to handle member 10 and allow them to pivot with respect thereto. Clamping members 12 and 14 comprise a center section 12*a* and 14*a* which is generally planar and extends in a generally vertical direction; top flanges 12*b* and 14*b* which extend inwardly from the top of sections 12*a* and 14*a*, respectively; and bottom flanges 12*c* and 14*c* which extend inwardly from the lower extremity of center sections 12*a* and 14*a*, respectively.

Figure 3:
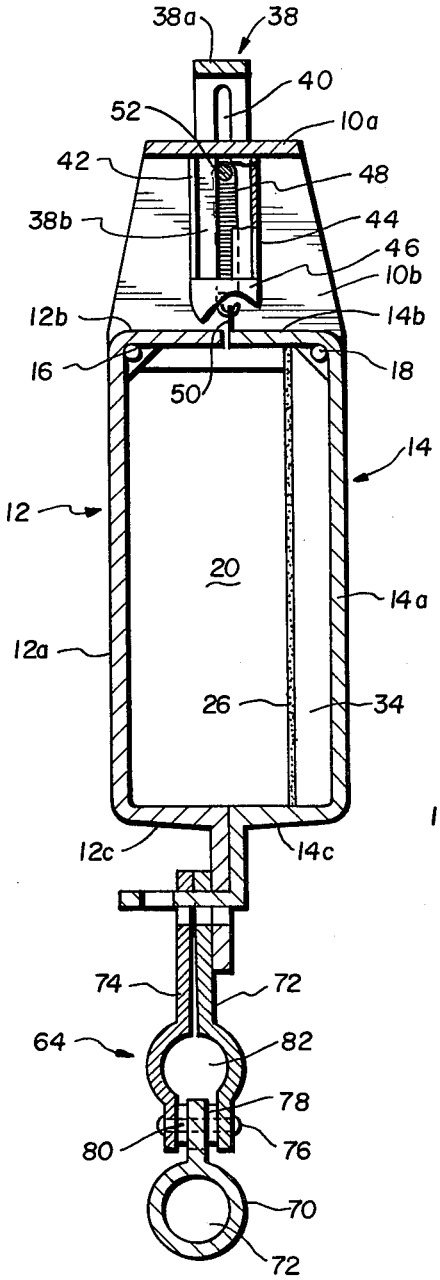
FIG. 3 is a vertical sectional view showing the ski carrier in a closed position assembled with the ski pole carrier taken along lines 3—3 in FIG. 1.

As can best be seen in FIG. 3, the orientation of clamping members 12 and 14, when in their closed position, define a cavity 20 which is capable of receiving a pair of skis 22 and 24, shown in phantom in FIG. 1. In order to accommodate various sized skis and to insure a firm grip by the clamping members, resilient pads 26 and 28 are retained between the flanges 30 and 32 located near one end of clamping member 14, and flanges 34 and 36 located near the opposite edge of this clamping member. Pads 26 and 28 may be rubber or foam or any other material that will exhibit a slight resiliency and be capable of enduring the severe weather conditions under which the device will be utilized.

Figure 4:
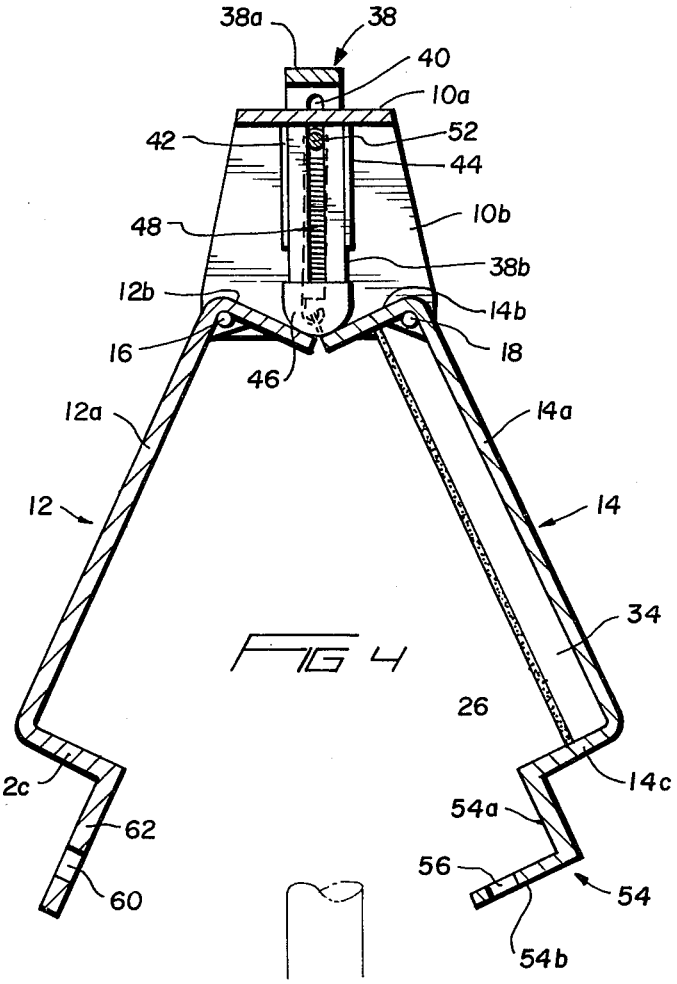
FIG. 4 is a vertical sectional view of the ski carrier taken along lines 3—3 in FIG. 1 showing the carrier in an open position.

The actuating means for opening and closing clamping members 12 and 14 comprises actuating member 38 which is slidably attached to hand gripping portion 10*a* such that a first portion 38*a* extends above the hand gripping portion 10*a*, and a pair of depending legs 38*b* extend downwardly through the hand gripping portion 10*a*, as shown in FIGS. 1, 3 and 4. Depending legs 38*b* on either end of first portion 38*a* define a slot 40, the purpose of which will be hereinafter described. In order to prevent undesired lateral motion of actuating means 38 with respect to handle member 10, guide elements 42 and 44 extend inwardly from the interior surface of depending portions 10*b* and 10*c*, respectively, and slidably contact the lateral edges of depending legs 38*b*. Guide elements 42 and 44 also act as a vertical stop for actuating means 38 by contacting the upper surface of cam element 46, which is attached to each lower extremity of depending legs 38*b*. Contact between guides 42 and 44 and the upper surface of cam element 46 limits the upward vertical movement of actuating means 38 with respect to handle member 10.

Spring 48 is connected between upper flange 14*b* and depending portion 10*b* as shown in FIGS. 3 and 4. This may be accomplished by hooking one end of spring 48 onto connecting flange 50 formed on flange 14*b* and hooking the opposite end over rod 52 which extends between depending portions 10*b* and 10*c*. Any known means may be utilized to affix rod 52 to the depending portions 10*b* and 10*c*, but the exterior surface of depending portions 10*b* and 10*c* should be flush or smooth so as to prevent the snagging of clothing or possible injury to the user. Similarly, the exterior portions of pivots 16 and 18 should also be flush with the exterior surface of depending portions 10*b* and 10*c*.

As shown, rods 52 extend generally parallel to hand gripping portion 10*a* and have their longitudinal axes extending in a direction generally parallel to the longitudinal axes of skis 22, 24. This enables the skier to easily carry the skis at his side. Quite obviously, other orientations may be utilized without exceeding the scope of this invention.

Although not shown, a similar spring is attached to rod 52 adjacent depending portion 10*c* between the corresponding guide elements 42 and 44, but is attached to clamping element 12 by a connecting member analogous to element 50. In their normal state, springs 48 exert an upward force on top flanges 12*b* and 14*b* thereby causing clamping elements 12 and 14 to normally assume the closed position as shown in FIGS. 1 and 3. Downward movement of actuating means 38 with respect to handle member 10 causes clamping members 12 and 14 to rotate about their respective pivots 16 and 18 due to the force exerted on top flanges 12*b* and 14*b* by cam element 46, as shown in FIG. 4. The width between bottom flanges 12*c* and 14*c* in the open position is sufficient to enable the device to be placed over skis 22 and 24 such that, when actuating means 38 is released, the skis are clamped in cavity 20 between the clamping elements 12 and 14.

Slot 40, previously described, allows vertical movement of actuating means 38 with respect to handle member 10 without interference from spring attachment rod 52. Since springs 48 are located between lateral guide elements 42 and 44 and between the depending portions of the handle member and the depending legs 38*b* of the actuating means, they are substantially in a closed, protected space to minimize the intrusion of snow, ice, etc.

Hook member 54 extends downwardly from bottom flange 14*c* and comprises depending portion 54*a* and lateral portion 54*b*. Lateral portion 54*b* defines opening 56 which is of sufficient diameter to accommodate a standard cable locking mechanism 58, shown in phantom lines in FIG. 1. These known devices generally comprise a flexible cable having a free end which is inserted into a locking mechanism so as to form a closed loop, as shown. The locking mechanism may either be key operated or operated by a combination tumbler.

When clamping members 12 and 14 are in their closed position, lateral portion 54*b* of hook element 54 extends through a slot 60 formed in locking member 62 which depends from bottom flange 12*c*. As shown in FIGS. 1 and 3, the length of lateral portion 54*b* is sufficient to position opening 56 completely through locking member 62. The length is also sufficient to accommodate holding means 64 which holds a pair of ski poles, shown in phantom as elements 66 and 68 in FIG. 1.

Holding means 64 comprises a first holding element 70 which defines an opening 72 therethrough to accommodate ski pole 66. First holding element 70 is permanently attached to ski pole 66. Second holding element 72 and 74 are pivotally attached to first holding element 70 by way of rivets 76. Quite obviously, although a rivet connection is shown, any other known means may be utilized to affix second holding elements 72 and 74 to first holding element 70. Resilient washers 78 and 80 are interposed between second holding elements 72 and 74 and first holding element 70 as shown best in FIG. 3.

Second holding elements 72 and 74 each have an arcuate portion adjacent their connection to first holding element 70 so as to define cavity 82 therebetween, which is sized so as to receive a ski pole therein. Second holding elements 72 and 74 also have an extending portion extending upwardly from the arcuate portion which defines co-aligned slots in the two members such that the holding means 64 may be placed over the lateral hook extension 54*b* as shown in FIGS. 1 and 3. The opening 56 in lateral portion 54*b* is located outwardly of second holding elements 72 and 74 such that, when cable lock mechanism 58 is inserted through opening 56, it is impossible to remove holding means 64 from hook member 54. Thus, the locking mechanism serves to secure the ski pole holding means to the clamping members, and serves to prevent the clamping members from moving from their closed position.

Figure 5:
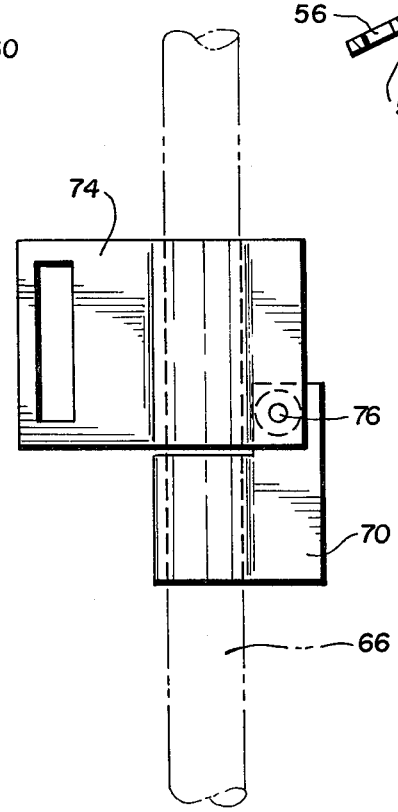
FIG. 5 is a side view of the skip pole carrier showing it in its folded position.

It is envisioned that the holding means 64 may be fabricated from a polypropylene material and possess an inherent resiliency. This inherent resiliency in second holding elements 72 and 74, coupled with the resiliency of washers 78 and 80, allows the second holding elements 72 and 74 to be physically moved apart thereby enabling them to be folded over onto ski pole 66 as shown in FIG. 5. In this position, the holding means remains attached to ski pole 66 and enables the user to use the ski poles in normal fashion.

From the foregoing description, it is evident that the invention presents a device for carrying ski equipment such as skis and poles that is easy to use and provide secure means for locking the equipment onto the carrier. In describing the operation of the device, it will be assumed that holding means 64 is attached to one of the skier's poles 66 in its folded position as shown in FIG. 5. When in this position, the holding means does not interfere with the skier's use of the skier's pole in normal fashion. When the user is done skiing he removes his skis and places them in back-to-back orientation. The handle member is grasped in one hand and the actuating means 38 is pushed downwardly by merely closing the fist around the actuating means 38 and the hand gripping portion 10*a*. As shown in FIG. 4, this downward movement of actuating means 38 opens clamping members 12 and 14 to enable them to be placed around skis 22 and 24 as shown in FIG. 1. When the clamping members are in the desired position, the user opens his fist thereby enabling springs 48 to close clamping members 12 and 14 about the skis.

Second holding elements 72 and 74 are then moved slightly apart and pivoted about axis 76 from the position shown in FIG. 5 to the position shown in FIGS. 1 and 3. Second ski pole 68 is then inserted into cavity 82 and the entire holding means 64 placed over hook member 54. Locking means 58 may then be inserted through opening 56 to securely lock all of the elements together and prevent the opening of clamping members 12 and 14.

The various elements of the carrying device may, of course, be fabricated from any material, although it is envisioned that a plastic material, such as ABS or nylon, will provide the requisite structural rigidity. Also, the various elements may be formed as separate pieces or may be integrally molded without exceeding the scope of this invention.

The foregoing description of the preferred embodiment is presented for illustrative purposes only and should not in any way be construed as limiting the scope of this invention which is defined solely by the appendant claims.

I claim:

1. A device for carrying ski equipment comprising:

(a) a handle member having a hand gripping portion and a depending portion at each end of the hand gripping portion;

(b) a pair of clamping members pivotally attached to the depending portions of the handle member and movable between open and closed positions, each clamping member having a center section, a top flange extending inwardly from the top of the center section, and a bottom flange extending inwardly from the bottom of the center section such that, when the clamping members are in the closed position, they define between them a cavity for holding a pair of skis;

(c) holding means attached to at least one of the bottom flanges for holding a pair of ski poles; and, (d) manually operable actuating means to move the clamping members between the closed and open positions.

2. The device for carrying ski equipment as set forth in claim 1 wherein the actuating means comprises:

(a) an actuating member slidably attached to the handle member such that a first portion extends above the hand gripping portion and a second portion extends below the hand gripping portion; and, (b) a cam element on the second portion bearing against the upper flanges of the clamping members such that downward movement of the actuating member with respect to the handle member moves the clamping members from their closed to their open positions.

3. The device for carrying ski equipment as set forth in claim 2 further comprising spring biasing means attached between the handle member and the clamping members which serves to bias the clamping members in their closed positions.

4. The device for carrying ski equipment as set forth in claim 3 wherein the second portion of the actuating member comprises a pair of depending legs which extend downwardly through the hand gripping portion, and a cam element attached to the end of each leg.

5. The device for carrying ski equipment as set forth in claim 4 further comprising guide elements located on the interior of each depending portion of the handle member, which guides slidably contact each of the depending legs of the actuating member to prevent undesired lateral movement.

6. The device for carrying ski equipment as set forth in claim 5 further comprising at least one pad of resilient material attached to one of the clamping members, the resilient pad bearing against one of the skis being carried by the device to keep the skis in close contact with each other.

7. The device for carrying ski equipment as set forth in claim 6 wherein the holding means comprises:

(a) a hook member extending from a bottom flange of one of the clamping members;

(b) a first holding element attached to a first ski pole; and (c) a pair of second holding elements pivotally attached to the first holding element, each of the second holding elements having an extending portion defining an opening which is engageable by the hook member, and an arcuate portion which defines a cavity between the second holding elements for receiving a ski pole; each of the second holding elements also being pivotable from a first position in which the ski pole is received in the cavity, and a second position in which a second ski pole may be received in the cavity.

8. The device for carrying ski equipment as set forth in claim 7 wherein the hook member has an opening therethrough and further comprising a locking member depending from a bottom flange of a clamping member and located opposite the hook member, the locking member having an opening to allow passage therethrough of a portion of the hook member such that, when the clamping members are in their closed position and a locking device is passed through the opening in the hook member, the clamping members cannot move to their open position.

9. The device for carrying ski equipment as set forth in claim 1 further comprising at least one pad of resilient material attached to one of the clamping members, the resilient pad bearing against one of the skis being carried by the device to keep the skis in close contact with each other.

10. The device for carrying ski equipment as set forth in claim 1 wherein the holding means comprises:

(a) a hook member extending from a bottom flange of one of the clamping members;

(b) a first holding element attached to a first ski pole; and (c) a pair of second holding elements pivotally attached to the first holding element, each of the second holding elements having an extending portion defining an opening which is engageable by the hook member, and an arcuate portion which defines a cavity between the second holding elements for receiving a ski pole; each of the second holding elements also being pivotable from a first position in which the first ski pole is received in the cavity, and a second position in which a second ski pole may be received in the cavity.

11. The device for carrying ski equipment as set forth in claim 10 wherein the hook member has an opening therethrough and further comprising a locking member depending from a bottom flange of a clamping member and located opposite the hook member, the locking member having an opening to allow passage therethrough of a portion of the hook member such that, when the clamping members are in their closed position and a locking device is passed through the opening in the hook member, the clamping members cannot move to their open position.

* * * * *